US008718521B2

(12) United States Patent
Chiba et al.

(10) Patent No.: US 8,718,521 B2
(45) Date of Patent: May 6, 2014

(54) IMAGE-FORMING APPARATUS AND IMAGE FORMING METHOD FOR REGULATING PORTION OF TENSION ROLLER

(75) Inventors: Satoshi Chiba, Nagano (JP); Ken Ikuma, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 294 days.

(21) Appl. No.: 13/225,858

(22) Filed: Sep. 6, 2011

(65) Prior Publication Data

US 2012/0063820 A1 Mar. 15, 2012

(30) Foreign Application Priority Data

Sep. 13, 2010 (JP) ..... 2010-204415

(51) Int. Cl.
*G03G 15/01* (2006.01)

(52) U.S. Cl.
USPC ..... 399/304

(58) Field of Classification Search
USPC ..... 399/304, 302, 308, 305, 318
See application file for complete search history.

(56) References Cited

U.S. PATENT DOCUMENTS 4,875,069 A * 10/1989 Takada et al. ..... 399/304
6,120,143 A * 9/2000 Narushima et al. ..... 399/304 X
7,203,446 B2 * 4/2007 Miura et al. ..... 399/302 X
7,711,300 B2 * 5/2010 Nakafuji et al. ..... 399/308 X
2008/0253813 A1 * 10/2008 Inaba et al. ..... 399/318
2010/0031837 A1 2/2010 Feygelman et al.
2010/0189476 A1 7/2010 Tanaka et al.

FOREIGN PATENT DOCUMENTS

JP 2006-513883 T 4/2006
JP 2010-170004 A 8/2010
WO WO-2004/067277 A1 8/2004

* cited by examiner

*Primary Examiner* — Sandra Brase
(74) *Attorney, Agent, or Firm* — Global IP Counselors, LLP

(57) ABSTRACT

An image-forming apparatus includes a transfer roller having a recessed portion in a circumferential surface; a driving portion for rotatably driving the transfer roller; an image carrier belt for carrying an image; a tension roller around which the image carrier belt is wound for making contact with the transfer roller interposed by the image carrier belt; a biasing portion for biasing the tension roller towards the transfer roller; and a position-regulating portion that, when the transfer roller rotates and the transfer roller and the image carrier belt make contact, causes a position to be maintained at which the image carrier belt wound around the tension roller intersects a virtual circumferential surface that is an extension of the circumferential surface of the transfer roller into the recessed portion.

8 Claims, 9 Drawing Sheets

IMAGE-FORMING APPARATUS AND IMAGE FORMING METHOD FOR REGULATING PORTION OF TENSION ROLLER

CROSS-REFERENCE TO RELATED APPLICATIONS

This application claims priority to Japanese Patent Application No. 2010-204415 filed on Sep. 13, 2010. The entire disclosure of Japanese Patent Application No. 2010-204415 is hereby incorporated herein by reference.

BACKGROUND

1. Technological Field

The present invention relates to an apparatus and method for forming an image using a transfer roller having a recessed portion provided in a circumferential surface to transfer an image on a belt-shaped image carrier to a transfer medium.

2. Background Technology

A known example of an image-forming apparatus using a transfer roller having a recessed portion provided in the circumferential surface to transfer an image to a transfer medium is described in Patent Citation 1. In this apparatus, a gripping portion such as a gripper is provided in the recessed portion of the transfer roller, the leading edge portion of the transfer medium is gripped, and the transfer medium is moved in a predetermined direction while passing through a transfer nip (transfer position) formed by an intermediate transfer belt and the circumferential surface of the transfer roller excluding the recessed portion. When the transfer roller is rotated only at a predetermined angle, the gripper releases its grip on the leading edge portion of the transfer medium, and the leading edge portion of the transfer medium is separated from the circumferential surface of the transfer roller and moved towards the fixing unit. The image on the intermediate transfer belt is transferred to the transfer medium by the transfer nip while the transfer medium is being moved in this manner.

Japanese Laid-open Patent Publication No. 2010-170004 (e.g. FIG. 1) (Patent Citation 1) discloses such image-forming device for example.

SUMMARY

Problems to be Solved by the Invention

However, in the apparatus described in Patent Citation 1, transfer nip formation by the transfer roller and the intermediate transfer belt is eliminated in the interval in which the recessed portion of the transfer roller opposes the intermediate transfer belt, and the leading edge of the transfer medium is gripped by the gripping portion. Then, after the recessed portion of the transfer roller has passed the transfer position, the circumferential surface of the transfer roller and the intermediate transfer belt begin to make contact with each other, and the transfer nip is formed. However, a fixed period of time has to elapse for the transfer load acting on the transfer nip reaches an appropriate value. Thus, the image position on the intermediate transfer belt needs to be shifted upstream in the direction of travel so that the image is not transferred onto the transfer medium before the transfer load reaches the appropriate value. As a result, the margin on the leading edge of the transfer medium has to be increased.

One of the advantages of the aspects of the invention is to provide a technique to quickly set the transfer load to the appropriate value and reduce the margin on the leading edge of the transfer medium.

Means Used to Solve the Above-Mentioned Problems

In order to achieve the advantage, the invention is related to an image-forming apparatus, including a transfer roller having a recessed portion in a circumferential surface, a driving portion for rotatably driving the transfer roller; an image carrier belt for carrying an image; a tension roller around which the image carrier belt is wound, the tension roller adapted for making contact with the transfer roller interposed by the image carrier belt; a biasing portion for biasing the tension roller towards the transfer roller; and position-regulating portion that, when the transfer roller rotates and the transfer roller and the image carrier belt make contact, causes a position to be maintained at which the image carrier belt wound around the tension roller intersects a virtual circumferential surface that is an extension of the circumferential surface of the transfer roller into the recessed portion.

In order to achieve the advantage, further, the method for forming an image of the invention includes a tension roller around which an image carrier belt is wound is biased when a recessed portion formed in a circumferential surface of the tension roller opposes the tension roller; a virtual circumferential surface that is an extension of the circumferential surface of the tension roller is caused to intersect the image carrier belt; the tension roller and the image carrier belt make contact via a transfer medium when the virtual circumferential surface has intersected the image carrier belt; and, once the transfer roller and the image carrier belt have made contact, an image carried on the image carrier belt is transferred to the transfer medium in a transfer nip formed by the circumferential surface of the transfer roller and the image carrier belt.

In the invention configured in this manner (the image-forming apparatus and the image-forming method), when the virtual circumferential surface in which the circumferential surface of the transfer roller has been extended and the image carrier belt have intersected, the image carried on the image carrier belt is transferred to the transfer medium in the transfer nip formed by the circumferential surface of the transfer roller and the image carrier belt after the transfer roller has made contact with the image carrier belt via the transfer medium. The circumferential surface of the transfer roller begins to make contact with the image carrier belt in parallel with the recessed portion separating from the tension roller in this manner, and the transfer load is set to an appropriate value more quickly than in the past. As a result, an image can be transferred to a transfer medium closer to the leading edge side of the transfer medium than in a prior art apparatus, and the leading edge margin of the transfer medium can be reduced.

The position-regulating portion may have a rotating member rotating on the same rotation shaft as the rotation shaft of the transfer roller, and a supporting member for contacting the rotating member and regulating the interaxial distance between the transfer roller and the tension roller when the transfer roller and the image carrier belt make contact. By using a position regulating member configured as described above, the position of the tension roller can be reliably changed whether or not the recessed portion is facing the tension roller, and the position of the image carrier belt can be stabilized relative to the transfer roller.

The way in which the image carrier belt travels changes in response to a change in the position of the tension roller, but one or more tensioning rollers is provided to make contact with the tension carrier belt and adjust the tension of the image carrier belt. This stabilizes the tension of the image carrier belt so that a good image can be transferred to the transfer medium.

The tension roller may also have a gripping portion arranged in the recessed portion, the gripping portion adapted for gripping a transfer medium. When this configuration is used, the transfer medium can be reliably separated from the image carrier belt after the image carried on the image transfer belt has been transferred to the transfer medium.

Also, the position-regulating portion is configured so that a position will be maintained at which the gripping portion and the image carrier belt do not touch when the tension roller and the image carrier belt make contact. This prevents interference between the gripping portion and the image carrier belt.

In addition, the outside diameter of the tension roller may be smaller than the outside diameter of the transfer roller.

DETAILED DESCRIPTION OF EXEMPLARY EMBODIMENTS

Figure 1:
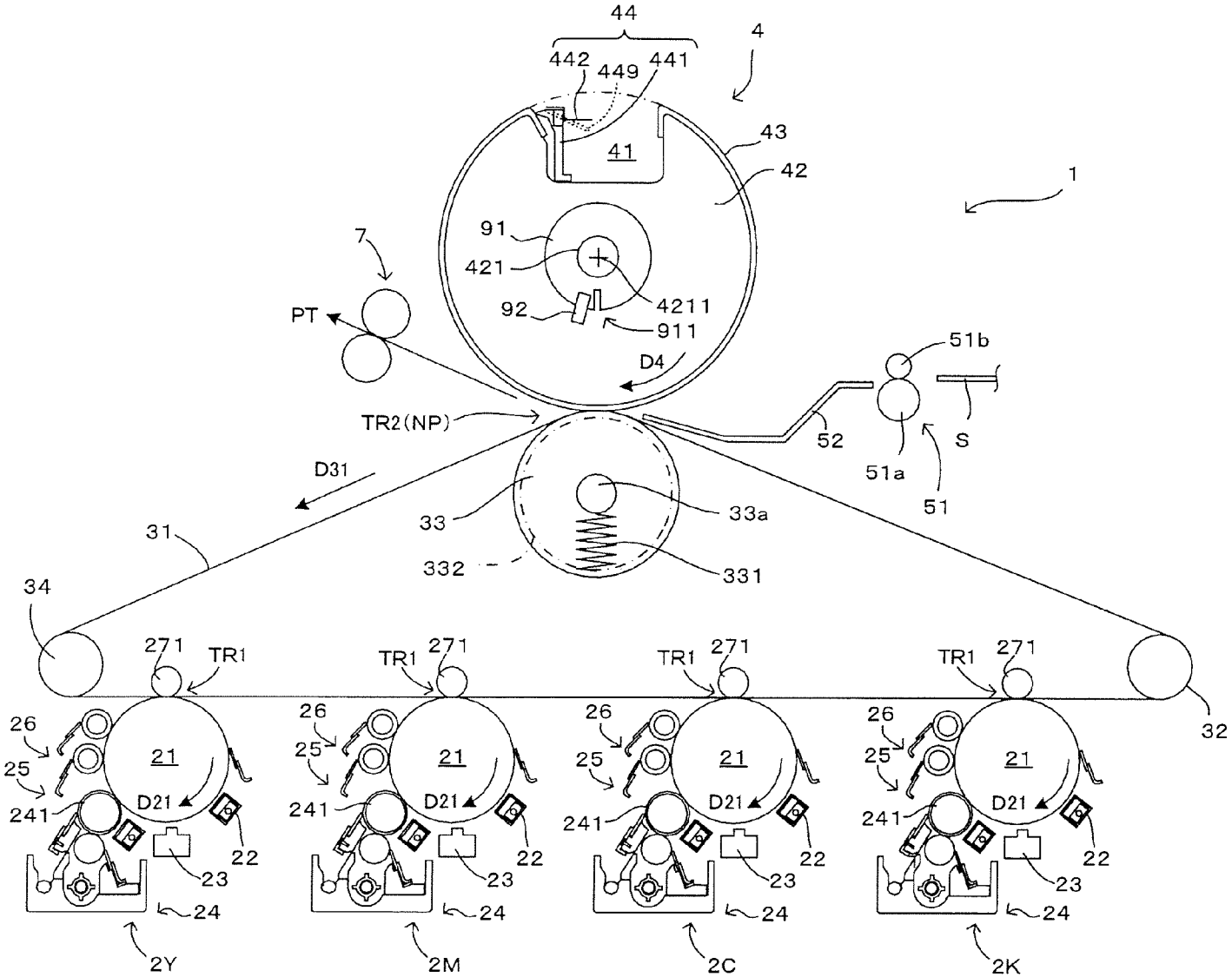
FIG. 1 is a view of the image-forming apparatus in a first embodiment of the invention.
Figure 2:
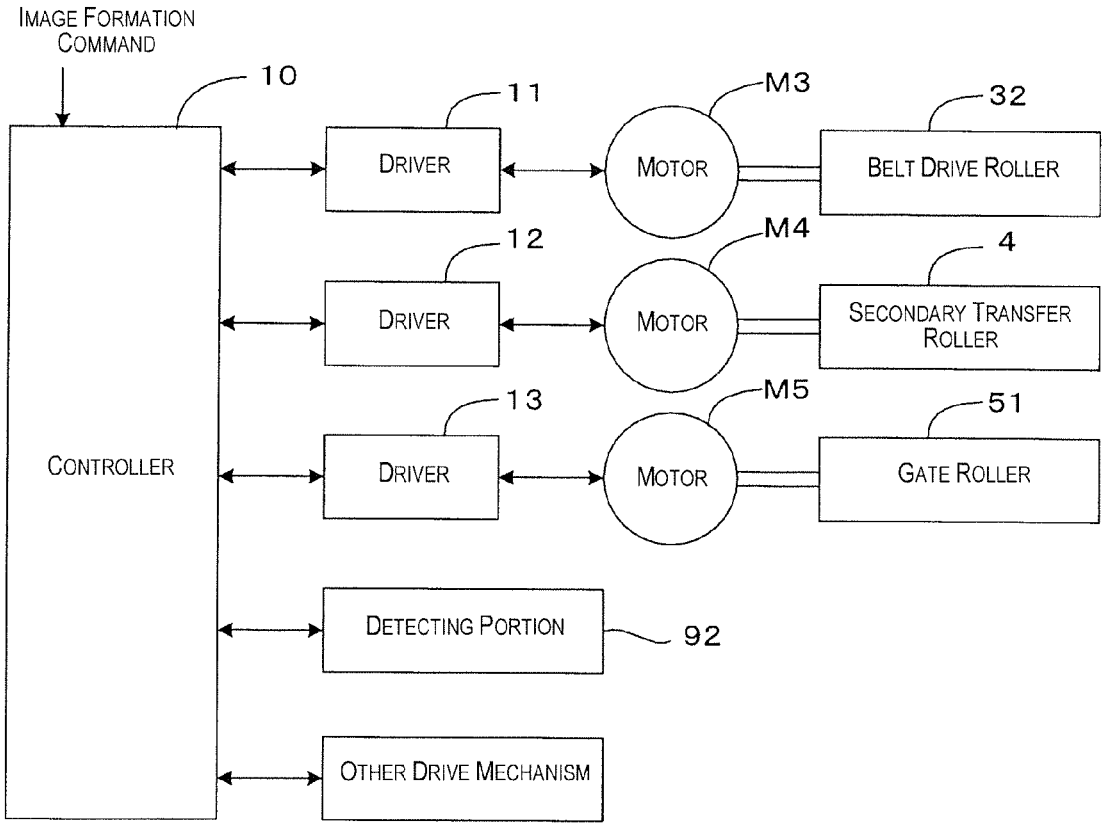
FIG. 2 is a block diagram showing the electrical configuration of the apparatus in FIG. 1.

FIG. 1 is a view of the image-forming apparatus in a first embodiment of the invention. FIG. 2 is a block diagram showing the electrical configuration of the apparatus in FIG. 1. This image-forming apparatus 1 has four image forming stations for forming images of different colors: 2Y (for yellow), 2M (for magenta), 2C (for cyan), and 2K (for black). The image-forming apparatus 1 is selectively executable in color mode, in which a color image is formed by superimposing toner of four colors (yellow (Y), magenta (M), cyan (C), and black (K)) and in monochromatic mode, in which a monochromatic image is formed using only black (K) toner. In this image-forming apparatus 1, when image formation commands are sent from an external device such as a host computer to a controller 10 having a CPU and memory, the controller 10 controls each component in the apparatus to execute a predetermined image forming operation, and an image corresponding to the image formation commands is formed on a sheet-like transfer medium S such as copy paper, transfer paper, general-purpose paper, or a transparent overhead projector (OHP) sheet.

A photosensitive drum 21 is provided in each image forming station 2Y, 2M, 2C, and 2K, and a toner image of the respective color is formed on the surface of each photosensitive drum. Each photosensitive drum 21 is arranged so the rotation shaft of each drum is parallel to or substantially parallel to the main scanning direction (the direction perpendicular to the plane of FIG. 1), and is rotatably driven at a predetermined speed in the direction of arrow D21 in FIG. 1.

On the periphery of each photosensitive drum 21 are arranged a charger 22 that is a corona charger for charging the surface of the photosensitive drum 21 to a predetermined potential, an exposure unit 23 for exposing the surface of the photosensitive drum 21 based on image signals to form an electrostatic latent image, a developing unit 24 for rendering visible the electrostatic latent image as a toner image, a first squeeze unit 25, a second squeeze unit 26, a primary transfer unit for performing the primary transfer of the toner image to an intermediate transfer belt 31, and a cleaning blade for cleaning the surface of the photosensitive drum 21 after a transfer. These components are arranged in successive order around the photosensitive drum 21 in the direction of rotation D21 (clockwise in FIG. 1).

The charger 22 does not touch the surface of the photosensitive drum 21. A corona charger common in the art can be used as the charger 22. When the corona charger is a scorotron charger, a wire current flows through the charge wire of the scorotron charger, and a direct current (DC) grid charge bias is applied to the grid. By charging the photosensitive drum 21 with a corona discharge from the charger 22, the potential on the surface of the photosensitive drum 21 is set to a substantially uniform potential.

In the exposure unit 23, the surface of the photosensitive drum 21 is exposed to a laser beam based on image signals supplied from an external device to form an electrostatic latent image corresponding to the image signals. The exposure unit 23 can be configured so that a laser beam from a semiconductor laser is scanned using a polygon mirror, or so that a line head is created in which light emitting elements are arranged in the main scanning direction.

Toner from a developing roller 241 provided in the developing unit 24 is applied to the electrostatic latent image formed in this manner, and the electrostatic image is developed with the toner. In the developing unit 24 of the image-forming apparatus 1, toner development is performed using a developer in which approximately 20 wt % toner is suspended in a carrier liquid. The developer used in this embodiment is not a volatile developer commonly used in the art that has a low concentration of Isopar (trademark: Exxon) as a carrier (1-2 wt %), has a low viscosity, and is volatile at room temperature, but is instead a non-volatile developer that has a high concentration, has a high viscosity, and is not volatile at room temperature. In other words, in the developer of the present embodiment, solid particles having an average particle size of 1 μm, which are prepared by dispersing a colorant such as a pigment in a thermoplastic resin, are added along with a dispersant to a liquid solvent such as an organic solvent, silicone oil, mineral oil, or a vegetable oil to obtain a solid toner concentration of approximately 20%. The result is a developer having high viscosity (a viscoelasticity of 30 to 300 mPa·s at 25° C. using a HAAKE RheoStress RS600 set to a shear velocity of 1000 (1/S).

A first squeeze unit 25 is arranged downstream from the developing position in the rotational direction D21 of the photosensitive drum 21, and a second squeeze unit 26 is arranged downstream from the first squeeze unit 25. A squeeze roller is provided in each of the squeeze units 25, 26. Each squeeze roller makes contact with the surface of the photosensitive drum 21 to remove the excess carrier liquid and toner fog from the toner image. In this embodiment, the excess carrier liquid and toner fog are removed by the two squeeze units 25, 26, but there are no restrictions on the number and arrangement of squeeze units. For example, a single squeeze unit can be used.

The primary transfer of a toner image which has passed through the squeeze units 25, 26 to the intermediate transfer belt 31 is performed by the primary transfer unit. The intermediate transfer belt 31 is an endless belt whose surface; i.e., whose outer circumferential surface, serves as an image carrier able to temporarily carry a toner image. This belt is wound around a plurality of rollers 32, 33, 34. Among these rollers, roller 32 is connected mechanically to a belt drive motor M3, and functions as the belt drive motor for circumferentially driving the intermediate transfer belt 31 in the direction of arrow D31 in FIG. 1. As shown in FIG. 2, a driver 11 is provided in the image-forming apparatus to drive the belt drive motor M3. The driver 11 outputs drive signals corresponding to the command pulses supplied from the controller 10 to the belt drive motor M3. In this way, the belt drive roller 32 is rotated at a circumferential speed corresponding to the command pulses, and the surface of the intermediate transfer belt 31 travels circumferentially at a constant speed in direction D31.

Among rollers 32 through 34 around which the intermediate transfer belt 31 is wound, only the belt drive roller 32 is driven by the motor. The other rollers 33, 34 are driven rollers without a drive source. The intermediate transfer belt 31 is wound around the belt drive roller 32 downstream from the primary transfer position TR1 and upstream from the secondary transfer position TR2 described below in the belt traveling direction D31.

The primary transfer unit has a primary transfer backup roller 271, and the primary transfer backup roller 271 is arranged opposite the photosensitive drum 21 so as to pinch the intermediate transfer belt 31. In the primary transfer position TR1 at which the photosensitive drum 21 comes into contact with the intermediate transfer belt 31, the contact forms a primary transfer nip. The toner image on the photosensitive drum 21 is transferred to the outer circumferential surface of the intermediate transfer belt 31 (the lower surface at primary transfer position TR1) in the primary transfer nip. When the toner image at each image forming station 2Y, 2M, 2C, and 2K is transferred, toner images of each color are successively superimposed on the intermediate transfer belt 31 to form a full color toner image. When a monochromatic image has been formed, only the toner image corresponding to the color black at image forming station 2K is transferred to the intermediate transfer belt 31.

The toner image transferred to the intermediate transfer belt 31 in this manner is conveyed to the secondary transfer position TR2 past the position at which the belt is wound around the belt drive roller 32. At the secondary transfer position TR2, the secondary transfer roller 4 is fixedly arranged with respect to the roller 33 around which the intermediate transfer belt 31 is wound while pinching the intermediate transfer belt 31. The surface of the intermediate transfer belt 31 and the circumferential surface of the transfer roller 4 (excluding the recessed portion 41) come into contact with each other and form a transfer nip NP. The roller 33 functions as a secondary transfer backup roller, and the rotation shaft 33*a* of the backup roller 33 is supported by a biasing portion 331 or elastic member such as a spring to be capable of elastically moving closer to and away from the intermediate transfer belt 31.

At the secondary transfer position TR2, secondary transfer of the single-color or multiple-color toner image formed on top of the intermediate transfer belt 31 is performed to a transfer medium S conveyed along the conveyance route PT from the gate rollers 51 (a pair of rollers 51*a*, 51*b*). A transfer medium guide 52 is arranged between the gate roller 51 and the secondary transfer position TR2 so that the transfer medium S is sent into the secondary transfer position TR2 without touching the secondary transfer roller 4 and the intermediate transfer belt 31. In this embodiment, a toner image is formed using the wet development method in which a toner image is formed using a developer. Therefore, in order to obtain good transfer properties, the transfer medium S is preferably pressed against the intermediate transfer belt 31 in the secondary transfer nip NP using high compressive force. Also, because a developer is interposed, there is a high possibility that tackiness-induced jamming will occur with the transfer medium S on the intermediate transfer belt 31. Thus, a secondary transfer roller 4 is used in the image-forming apparatus 1, in which a recessed portion is provided in a portion of the circumferential surface, and in which a gripping portion is provided in the recessed portion as described below.

A transfer medium S with a secondary-transferred toner image is sent from the secondary transfer roller 4 to the fixing unit 7 provided on the conveyance route PT. The fixing unit 7 applies heat and/or pressure to the toner image transferred to the transfer medium S to fix the toner image to the transfer medium S.

Figure 3:
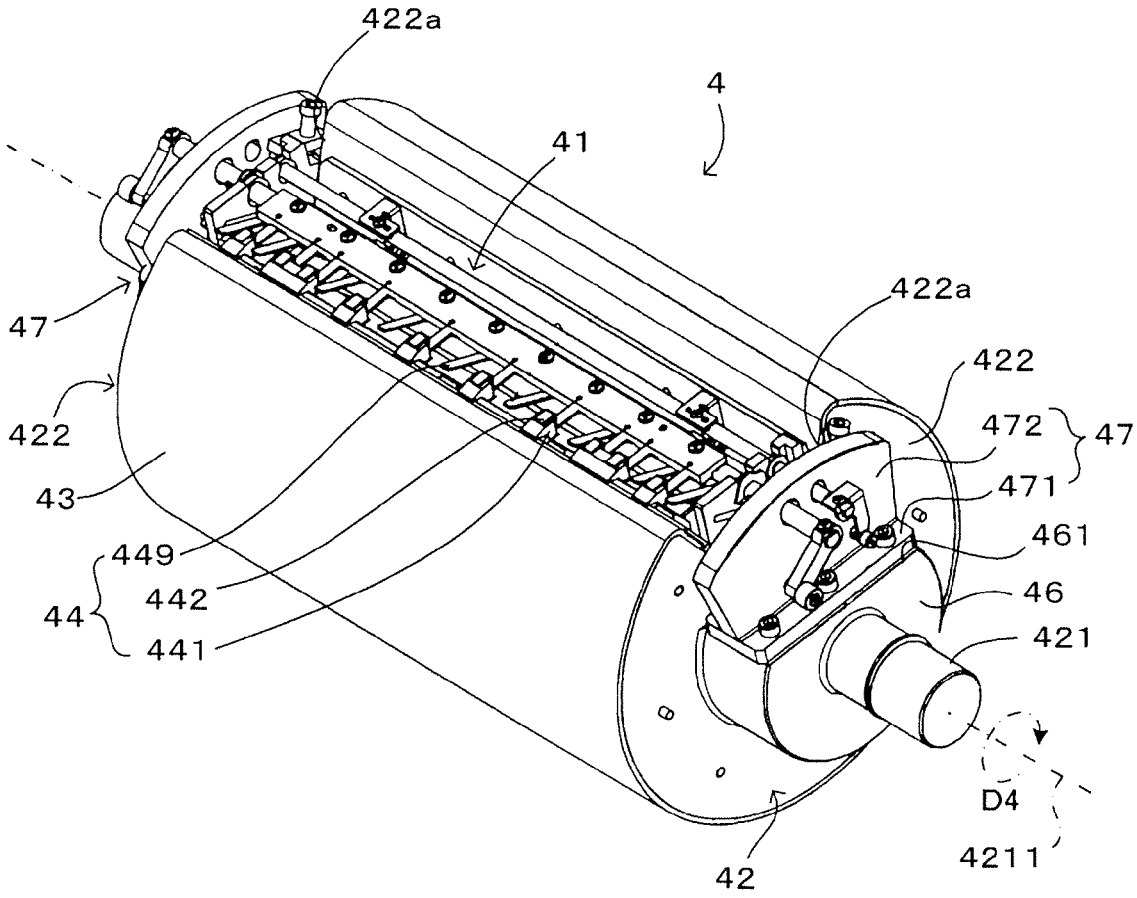
FIG. 3 is a perspective view showing the overall configuration of the secondary transfer roller.

FIG. 3 is a perspective view showing the overall configuration of the secondary transfer roller. As shown in FIG. 1 and FIG. 3, the secondary transfer roller 4 has a roller base 42 in which a recessed portion 41 has been provided by cutting out a portion of the outer circumferential surface of the cylinder. In the roller base 42, the rotating shaft 421 is arranged parallel to or substantially parallel to the rotation shaft 33*a* of the secondary transfer backup roller 33 so as to rotate freely around a rotation shaft 4211 in direction D4. As described below, it receives rotational drive force from the motor and rotates around the rotation shaft 4211 in direction D4 to a fixed position.

Side plates 422, 422 are attached to both ends of the rotational shaft 421. More specifically, both side plates 422, 422 have a shape in which a notched portion 422*a* is provided relative to a disk-shaped metal plate. As shown in FIG. 3, the notched portions 422*a*, 422*a* are opposed to each other, separated by a distance somewhat greater than the width of the intermediate transfer belt 31, and mounted on the rotating shaft 421. This forms a roller base 42 having a drum shape overall, but also having a recessed portion 41 in a portion of the outer circumferential surface extending parallel to or substantially parallel to the rotating shaft 421.

Also, an elastic layer 43 of rubber or plastic is formed on the outer circumferential surface, or outer plate surface, of the roller base 42 in an area of the surface excluding the area corresponding to the interior of the recessed portion 41. The elastic layer 43 opposes the intermediate transfer belt 31 wound around the backup roller 33 to form a secondary transfer nip NP. In the secondary transfer nip NP, the backup roller 33 is biased towards the secondary transfer roller 4 by the biasing portion 331 to apply a predetermined load to the intermediate transfer belt 31 where it is wound between the secondary transfer roller 4 and the backup roller 33.

Also, a gripping portion 44 is provided inside the recessed portion 41 to grip the transfer medium S. This gripping portion 44 has a gripper support member 441 erected from the inner bottom portion of the recessed portion 41 on the outer circumferential surface of the roller base 42, a gripper member 442 supported so as to freely connect with or disconnect from the end portion of the gripper support member 441, and transfer medium peeling member 449. Also, the gripper member 442 is connected to the gripper drive portion (not shown). An ungrip command is received from the controller 10, the gripper drive portion is activated, the end portion of the gripper member 442 is separated from the end portion of the gripper support member 441, and grip preparation and grip release is performed on the transfer medium S. Alternatively, a grip command is received from the controller 10, the gripper drive portion is activated, the end portion of the gripper member 442 moves to the end portion of the gripper support member 441, and the transfer medium S is gripped. By providing a gripping portion 44, the transfer medium S can be held in place reliably, and the transfer medium S can be separated from the intermediate transfer belt 31 after the toner image carried on the intermediate transfer belt 31 has been transferred to the transfer medium S.

Also, the transfer medium peeling member 449 is provided appropriately between the pair comprising the gripper member 442 and the gripper support member 441 in the axial direction of the secondary transfer roller 4. The transfer medium peeling member 449 protrudes towards the outside in the radial direction of the secondary transfer roller 4 to push the transfer medium S held by the gripper member 442 and the gripper support member 441 away from the secondary transfer roller 4. Thus, by activating the transfer medium peeling member 449 while separating the end portion of the gripper member 442 from the end portion of the gripper support member 441 to release the grip on the transfer medium S, the transfer medium S can be reliably peeled off the secondary transfer roller 4. The configuration of the gripping portion 44 is not restricted to the one used in this embodiment; other gripping mechanisms common in the art can also be used.

A support member 46 is mounted on the outer surface of each side plate 422 on both ends of the secondary transfer roller 4 so as to be able to rotate integrally with the roller base 42. A flat area 461 corresponding to the recessed portion 41 is formed on the support member 46. A transfer-roller-side abutting member 47 (transfer bearer) is mounted on the flat area 461. Thus, the abutting member 47 rotates around the rotation shaft 4211 along with the second transfer roller 4. In the abutting member 47, a base site 471 is mounted on the support member 46, an abutting member site 472 extends from the base site 471 in the direction normal to the flat area 461, and the end portion of the abutting member site 472 extends to the vicinity of the open end portion of the recessed portion 41. In other words, when the roller base 42 is viewed from the end portion of the rotating shaft 421, the abutting member 47 is arranged so as to block the recessed portion 41. Thus, when the secondary transfer roller 4 is rotated and the recessed portion 41 reaches the position opposite the intermediate transfer belt 31, the abutting member 47 makes contact with the circumferential surface of the bearing 332 mounted on the rotation shaft 33*a* of the secondary transfer backup roller 33, and the transfer nip NP is eliminated. The leading edge circumferential surface of the abutting member 472 has a predetermined curvature which adjusts the distance of the rotation shaft 33*a* of the secondary transfer backup roller 33 relative to the rotation shaft 4211 of the secondary transfer roller 4 in the interval where the recessed portion 41 faces the secondary transfer backup roller 33 (i.e., adjusts the interaxial distance between the secondary transfer roller 4 and the secondary transfer backup roller 33). In this embodiment, the bearing 332 and the transfer-roller-side abutting member 47 correspond to the "support member" and the "rotating member," and these constitute the "position-regulating portion" of the invention. This will be described in further detail below with reference to FIG. 4 and FIG. 5.

A transfer roller drive motor M4 is mechanically connected to the rotating shaft 421 of the secondary transfer roller 4. In this embodiment, a driver 12 is also provided to drive the transfer roller drive motor M4. The driver 12 drives the motor M4 based on commands supplied from the controller 10, and the secondary transfer roller 4 is rotatably driven in the clockwise direction D4 in FIG. 1 (i.e., in the width direction with respect to the belt traveling direction D31). The secondary transfer backup roller 33 is a driven roller without its own drive source. When the secondary transfer backup roller 33 opposing the secondary transfer roller 4 driven by the motor is itself driven, slippage can be prevented between the secondary transfer roller 4 and the intermediate transfer belt 31 in the transfer nip NP, or between the intermediate transfer belt 31 and the secondary transfer backup roller 33.

In this embodiment, an AC servo motor is used as the motor M4. It is configured so that the position and torque of the AC servo motor can be controlled by the driver 12. In other words, the driver 12 has a position control circuit and a torque control circuit, and position control and torque control can be selectively executed. Command pulses related to position information and control switching signals can be inputted by the controller 10 to the driver 12.

The apparatus 1 also includes a voltage generating portion for generating the bias voltage supplied to the various portions of the apparatus, a motor M5 for rotating a gate roller 51, as shown in FIG. 2, installed in addition to the secondary roller 4 and the belt drive roller 32, a driver 13 for driving the motor M5, and various types of drive mechanisms for driving the other portions of the apparatus. All of these operations are controlled by the controller 10.

The phase rotation of the secondary transfer roller 4 can be detected in the following manner. As shown in FIG. 1, a detected portion 91 is provided on the rotating shaft 421 of the secondary transfer roller 4. The detected portion 91 is formed in a disk shape having a slit-shaped notched portion 911 in a portion of the circumferential surface, and rotates with the secondary transfer roller 4. A detecting portion 92 composed of a photosensor such as a photointerceptor is provided on the housing side of the apparatus. When the secondary transfer roller 4 is rotated and the notched portion 911 in the detected portion 91 passes the detection position of the detection portion 92, the detection portion 92 outputs a synchronization signal Vsync synchronized with the rotation of the secondary transfer roller 4. In this way, the phase rotation of the secondary transfer roller 4 is detected. The controller 10 controls the operational timing of the various portions of the apparatus based on these synchronization signals Vsync, the leading edge portion of the transfer medium S sent to the secondary transfer position TR2 is gripped by the gripping portion 44 of the secondary transfer roller 4, the transfer medium S is moved in a predetermined traveling direction D4, and a toner image (image) is transferred to the transfer medium S. In this embodiment, the position regulating operation of the transfer roller abutting member 47 causes the transfer medium S to be gripped by the gripping portion 44 when the recessed portion 41 is facing the secondary transfer backup roller 33. Then, the intermediate transfer belt 31 is pressed against the circumferential surface (elastic layer 43) of the secondary transfer roller 4 and the secondary transfer begins before the recessed portion 41 is separated from the secondary transfer position TR2. This operation will now be described in detail with reference to FIG. 4 and FIG. 5.

Figure 4A:
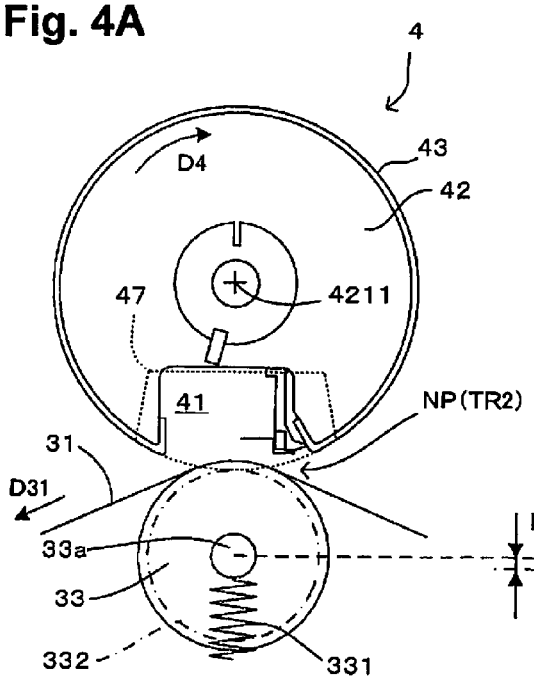
FIG. 4 is a diagram used to explain the operation of the abutting member in the first embodiment.
Figure 4B:
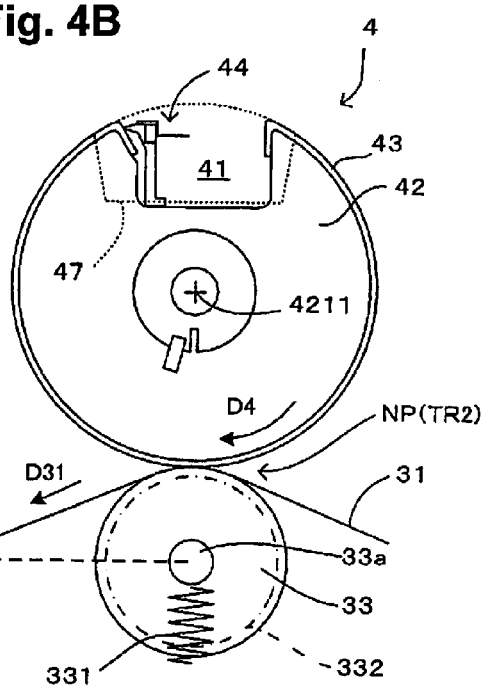

FIG. 4 is a diagram used to describe the operation of the abutting member (rotating member) in this first embodiment. FIG. 5 is a diagram showing the positional relationship between the recessed portion and the intermediate transfer belt. Among these figures, FIG. 4A is a view of both the secondary transfer roller 4 and the secondary transfer backup roller 33 from the axial direction when the recessed portion 41 opposes the secondary transfer backup roller 33, FIG. 4B is a view of both the secondary transfer roller 4 and the secondary transfer backup roller 33 from the axial direction when the circumferential surface of the secondary transfer roller 4 excluding the recessed portion 41 opposes the secondary transfer backup roller 33, FIG. 4C is a partially enlarged view of FIG. 4A, FIG. 4D is a partially enlarged view of FIG. 4B, and FIG. 4E is a schematic view showing the positional relationships of the various points in FIG. 4A and FIG. 4C. The schematic view in FIG. 5 is an enlarged view of the dashed line portion of FIG. 4A at each one of timings T1 through T3. In order to clearly depict the positional relationship between the recessed portion 41 and the intermediate transfer belt 31 wound around the secondary transfer backup roller 33 (this belt portion being referred to as "opposing portion 31*a*"), the transfer medium separating member 449, the abutting member 47, and the bearing 332 have been removed from the drawing, and a virtual circumferential outer surface VS extending the circumferential surface of the secondary transfer roller 4 to the recessed portion 41 has been added in the form of a dotted line.

Also, in order to clearly depict the positional relationship between the intermediate transfer belt 31 and the secondary transfer roller 4, points OP, AP, and BP in FIG. 4 are defined as follows.

Point OP: The point at which the axis AX connecting the rotation shaft 4211 of the secondary transfer roller 4 and the rotation shaft 33*a* of the secondary transfer backup roller 33 intersects the outer circumferential surface of the secondary transfer roller 4 or the virtual outer circumferential surface VS.

Point AP: The point at which the outer circumferential surface of the intermediate transfer belt 31 intersects axis AX.

Point BP: The point at which the outer circumferential surface of the secondary transfer roller 4 intersects axis AX.

Figure 4C:
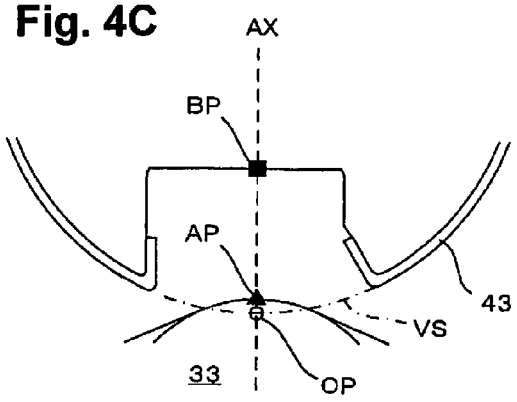
Figure 4D:
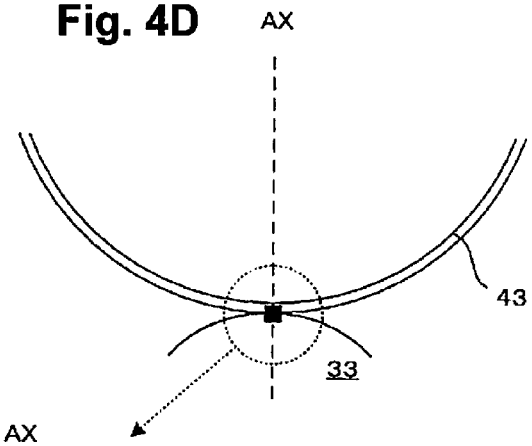
Figure 4E:
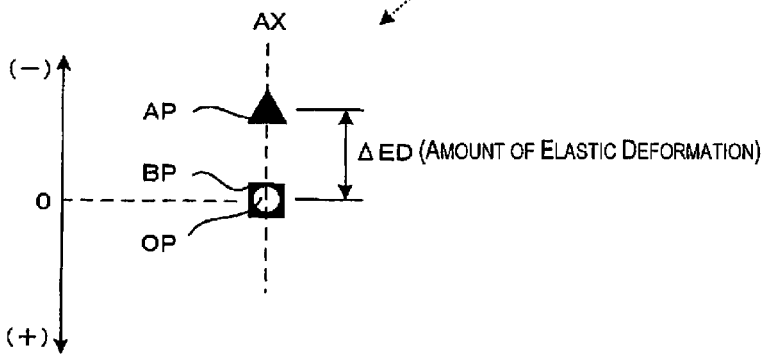
Figure 5:
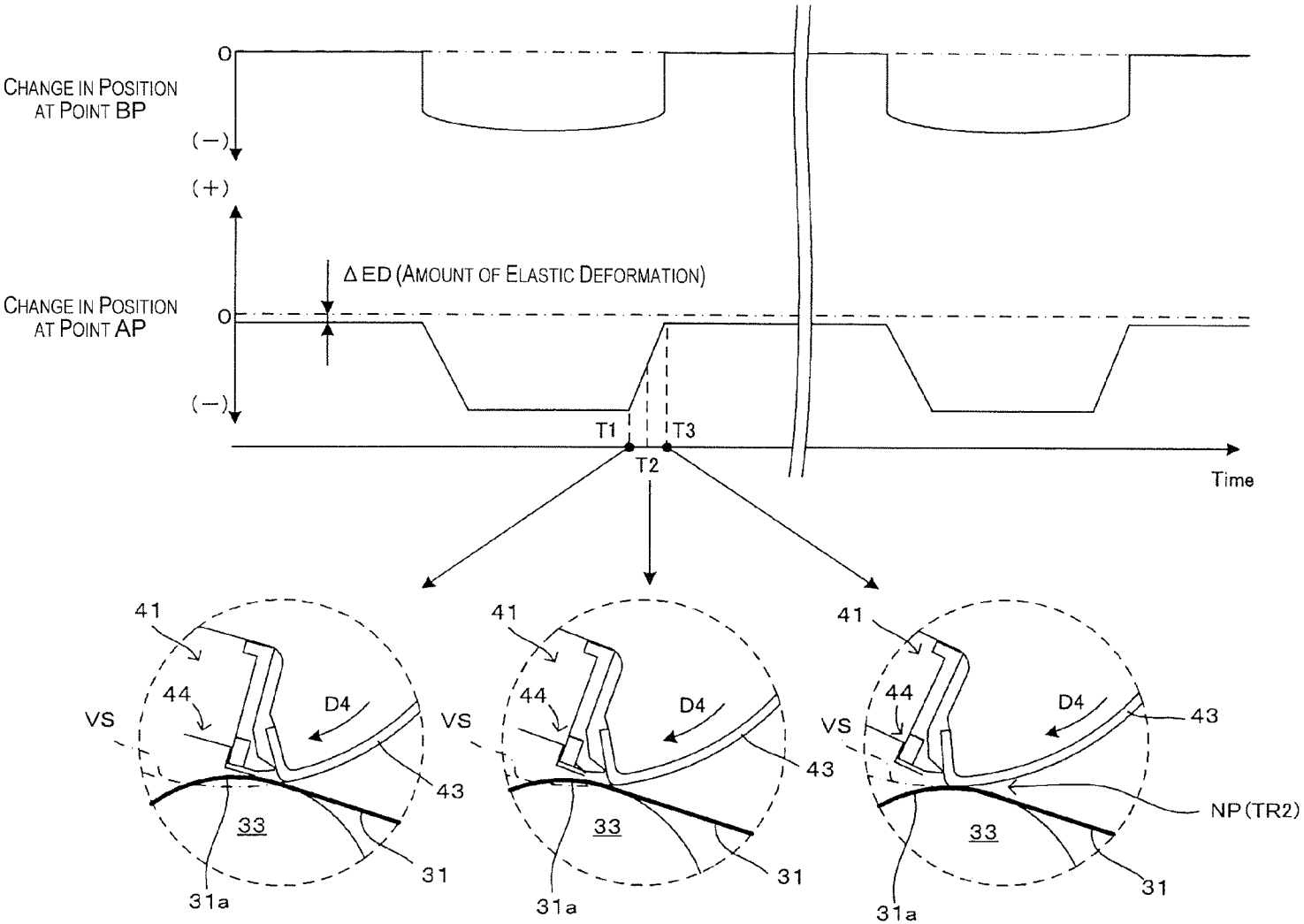
FIG. 5 is a diagram showing the positional relationship between the recessed portion and the intermediate transfer belt.

Among these points, point BP is aligned with the inner bottom surface of the recessed portion 41 when the recessed portion 41 is positioned on axis AX as shown in FIG. 4C, and is aligned with point OP when the elastic layer 43 is positioned on the axis AX as shown in FIG. 4E.

Also, as shown in FIG. 5, the change in the positional relationship between the intermediate transfer belt 31 and the secondary transfer roller 4 is expressed by the change in position of points AP and BP as defined above. In FIG. 5, the direction in which reference point OP is close to the rotation shaft 4211 of the secondary transfer roller 4 is defined as the minus side, and the direction in which it is far from the rotation shaft is defined as the plus side. In FIG. 4 and FIG. 5, ΔED corresponds to the amount of elastic deformation when the intermediate transfer belt 31 makes contact with the elastic layer 43 on the secondary transfer roller 4, and the elastic layer 43 is elastically deformed. Thus, when an elastic layer 43 is provided on the secondary transfer roller 4, and a transfer nip NP is formed, point AP approaches the rotation shaft 4211 of the secondary transfer roller 4 from reference point OP by the amount of elastic deformation. When an elastic layer 43 is not provided on the secondary transfer roller 4 and the circumferential surface of the secondary transfer roller 4 is rigid, point AP is aligned with reference point OP.

As shown in FIG. 4, the shape of the outer circumferential surface of the abutting member 47 is substantially arc-shaped, centering on the rotation shaft 4211 of the secondary transfer roller 4 in the area facing the recessed portion 41 of the secondary transfer roller 4. The end portion of the secondary transfer backup roller 33 has an outside diameter smaller than the diameter of the secondary transfer backup roller 33, and there is provided a freely rotating bearing 332 which is coaxial with and independent of the secondary transfer backup roller 33.

When the recessed portion 41 has moved to the position of the transfer nip NP (the secondary transfer position TR2), the abutting member 47 on the secondary transfer roller 4 faces the secondary transfer backup roller 33, and the outer circumferential surface of the abutting member 47 and the outer circumferential surface of the bearing 332 make contact with each other (FIG. 4A). This eliminates the transfer nip NP, adjusts the interaxial distance between the secondary transfer roller 4 and the secondary transfer backup roller 33, resists the biasing force of the biasing portion 331, and regulates the interval between the rotation shaft 4211 of the secondary transfer roller 4 and the surface of the intermediate transfer belt 31.

More specifically, as shown in FIG. 4, the secondary transfer roller 4 is arranged at a fixed position, and the abutting member 47 is configured so that the interaxial distance is shorter by distance H when the recessed portion 41 is positioned at secondary transfer position TR2, and the abutting member 47 makes contact with the bearing 332. Therefore, the distance from the rotation shaft 4211 of the secondary transfer roller 4 to the opposing portion 31*a* of the intermediate transfer belt 31 is smaller by distance H than the radius of the secondary transfer roller 4 on which an elastic layer 43 has been formed. As shown at timing T1 in FIG. 4A and FIG. 5, the opposing portion 31*a* is positioned closer to the rotation shaft 4211 than the virtual circumferential outer surface VS, and enters into the recessed portion 41. However, when the opposing portion 31*a* enters deeply into the recessed portion 41, it interferes with the gripping portion 44. Thus, in this embodiment, the abutting member 47 is designed so that the opposing portion 31*a* is positioned between the virtual circumferential outer surface VS and the gripping portion 44.

The secondary transfer roller 4 rotates in the traveling direction D4, the upstream end of the recessed portion 41 approaches the secondary transfer position TR2, the opposing portion 31*a* of the intermediate transfer belt 31 moves from the rotation shaft 4211 towards the virtual circumferential outer surface VS, the opposing portion 31*a* begins to make contact with the elastic layer 43 positioned on the upstream open side surface of the recessed portion 41 when the recessed portion 41 has moved away from the secondary transfer position TR2 (timing T2), and the transfer nip NP begins to form. The secondary transfer roller 4 is rotated further, and formation of the transfer nip NP is completed when the opposing portion 31*a* of the intermediate transfer belt 31 has made contact with the circumferential surface of the secondary transfer roller 4 excluding the recessed portion 41 (timing T3). The transfer medium S is pinched by the biasing portion 331 with the appropriate load, and the intermediate transfer belt 31 is pressed against the circumferential surface (elastic layer 43) of the transfer roller 4.

In this embodiment, as shown above, the secondary transfer roller 4 and the intermediate transfer belt 31 make contact via the transfer medium S when the virtual circumferential outer surface VS which is an extension of the circumferential surface of the secondary transfer roller 4 intersects the intermediate transfer belt 31. Afterwards, the image carried on the intermediate transfer belt 31 is transferred to the transfer medium S by the transfer nip NP formed by the circumferential surface of the secondary transfer roller 4 and the intermediate transfer belt 31. The circumferential surface of the secondary transfer roller 4 begins to make contact with the intermediate transfer belt 31 in parallel with the recessed portion 41 separating from the backup roller 33. As a result, the appropriate load can be applied to the secondary transfer position TR2 immediately after the recessed portion 41 has separated from the secondary transfer position TR2, and a good transfer nip NP can be formed with the circumferential surface near the recessed portion 41. In this way, an image can be transferred to a transfer medium S from the leading edge side of the transfer medium S, and the margin on the leading edge of the transfer medium S can be reduced.

Also, when the abutting member 47 rotates around the rotation shaft 4211 integrally with the secondary transfer roller 4, and the recessed portion 41 opposes the secondary transfer backup roller 33, the abutting member 47 makes contact with the backup roller 33 via the bearing 332. When the circumferential surface of the secondary transfer roller 4 excluding the recessed portion 41 makes contact with the backup roller 33, it separates from the bearing 332. Because the abutting member 47 makes contact with and separates from the backup roller 33 via the bearing 332, the backup roller 33 can change position reliably and the position of the opposing portion 31*a* of the intermediate transfer roller 31 can be stabilized relative to the secondary transfer roller 4 whether or not the recessed portion 41 opposes the backup roller 33. In this embodiment, the abutting member 47 is configured so as to make indirect contact with the backup roller 33 via the bearing 332. However, it can also be configured so as to make direct contact.

Also, the secondary transfer backup roller 33 has a roller diameter smaller than the secondary transfer roller 4. When the recessed portion 41 opposes the backup roller 33 as shown in FIG. 4A, the backup roller 33 preferably positions the intermediate transfer belt 31 closer to the rotation shaft 4211 of the secondary transfer roller 4 than the virtual circumferential outer surface VS.

In this embodiment, as mentioned above, the secondary transfer roller 4 corresponds to the "transfer roller" of the invention, the motor M4 corresponds to the "drive portion" of the invention, the intermediate transfer belt 31 corresponds to the "image carrier belt" of the invention, and the backup roller 33 corresponds to the "tension roller" of the invention.

The invention is not limited to the embodiment described above; several variations and modifications may be possible without departing from the scope of the invention. For example, in the embodiment, as shown in FIG. 5, the opposing portion 31*a* of the intermediate transfer belt 31 is always positioned closer to the rotation shaft 4211 than the virtual circumferential outer surface VS and enters into the recessed portion 41 when the recessed portion 41 opposes the secondary transfer backup roller 33. However, the invention can be configured so that the opposing portion 31*a* is deformed as shown in FIG. 6.

Figure 6:
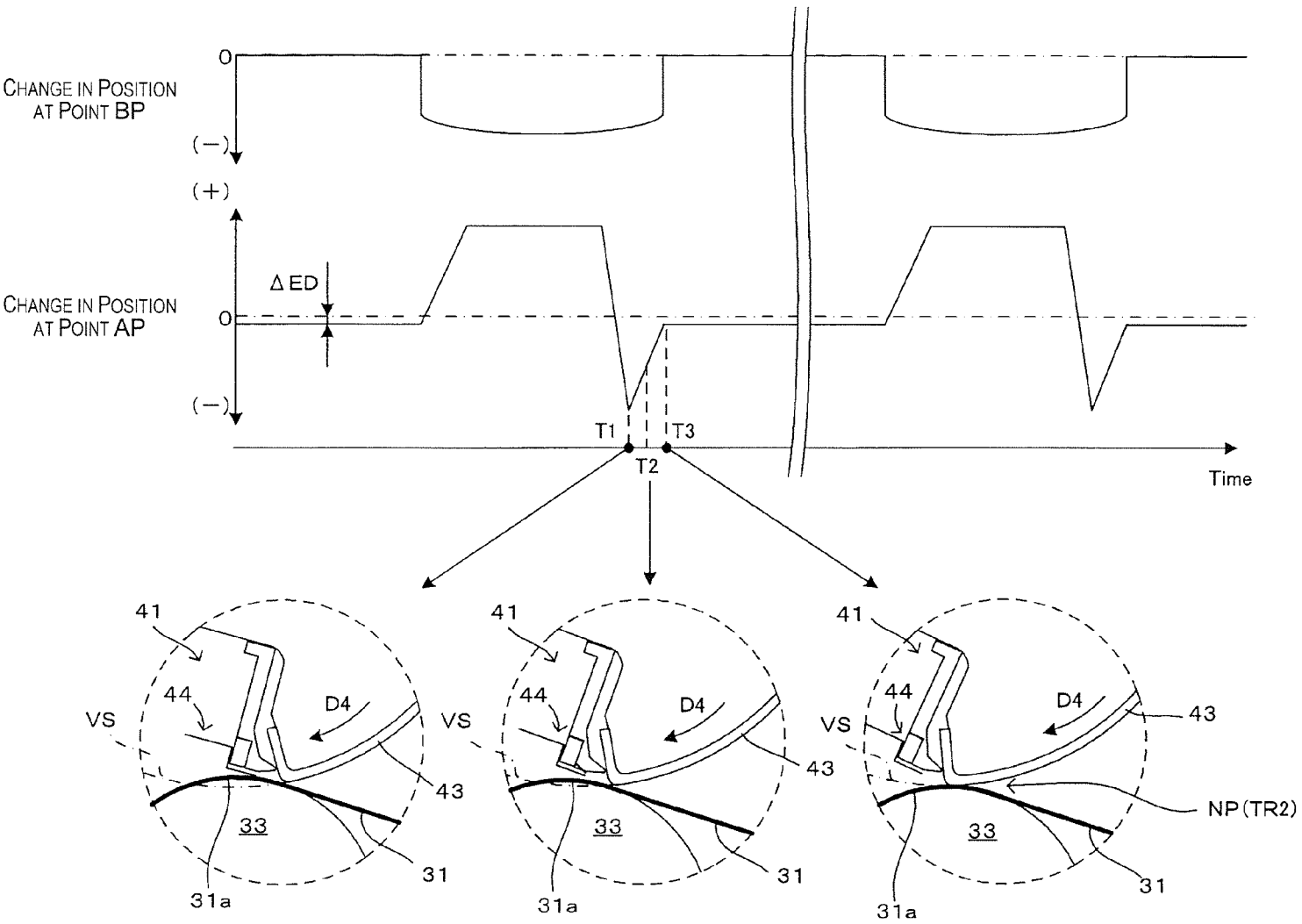
FIG. 6 is a diagram showing the positional relationship between the recessed portion and the intermediate transfer belt in the second embodiment.

FIG. 6 is a diagram showing the positional relationship between the recessed portion and the intermediate transfer belt in the second embodiment. In the second embodiment, during the first half of the interval in which the recessed portion 41 opposes the secondary transfer backup roller 33, the backup roller 33 is caused to move away from the rotation shaft 4211 (e.g., downward in FIG. 4) and separate from the recessed portion 41 while the abutting member 47 makes contact with the bearing 332 and counters the biasing force of the biasing portion 331. In the latter half, after the opposing portion 31*a* of the intermediate transfer belt 31 has returned to the virtual circumferential outer surface VS, as in the first embodiment, it is positioned closer to the rotation shaft 4211 than the virtual circumferential outer surface VS, and enters into the recessed portion 41 (timing T1). Afterwards, it returns towards the virtual circumferential outer surface VS (timing T3). At this time, as in the embodiment described above, the secondary transfer roller 4 rotates in the traveling direction D4. When the recessed portion 41 has separated from the secondary transfer position TR2 (timing T2), the opposing portion 31*a* begins to make contact with the elastic layer 43 positioned on the upstream side open surface of the recessed portion 41, and the transfer nip NP begins to form. When the secondary transfer roller 4 has rotated further and the opposing portion 31*a* of the intermediate transfer belt 31 has made contact with the circumferential surface of the secondary transfer roller 4 excluding the recessed portion 41 (timing T3), formation of the transfer nip NP is complete, the transfer medium S is pinched by the biasing portion 331 with the appropriate load, and the intermediate transfer belt 31 is pressed against the circumferential surface (elastic layer 43) of the transfer roller 4.

Thus, even in the second embodiment, when the virtual circumferential outer surface VS intersects the intermediate transfer belt 31, the secondary transfer roller 4 and the intermediate transfer belt 31 begin to make contact via the transfer medium S and, afterwards, the image carried on the intermediate transfer belt 31 is transferred to a transfer medium S by the transfer nip NP formed by the circumferential surface of the secondary transfer roller 4 and the intermediate transfer belt 31. As a result, the operational effects obtained are similar to those of the first embodiment.

Figure 7:
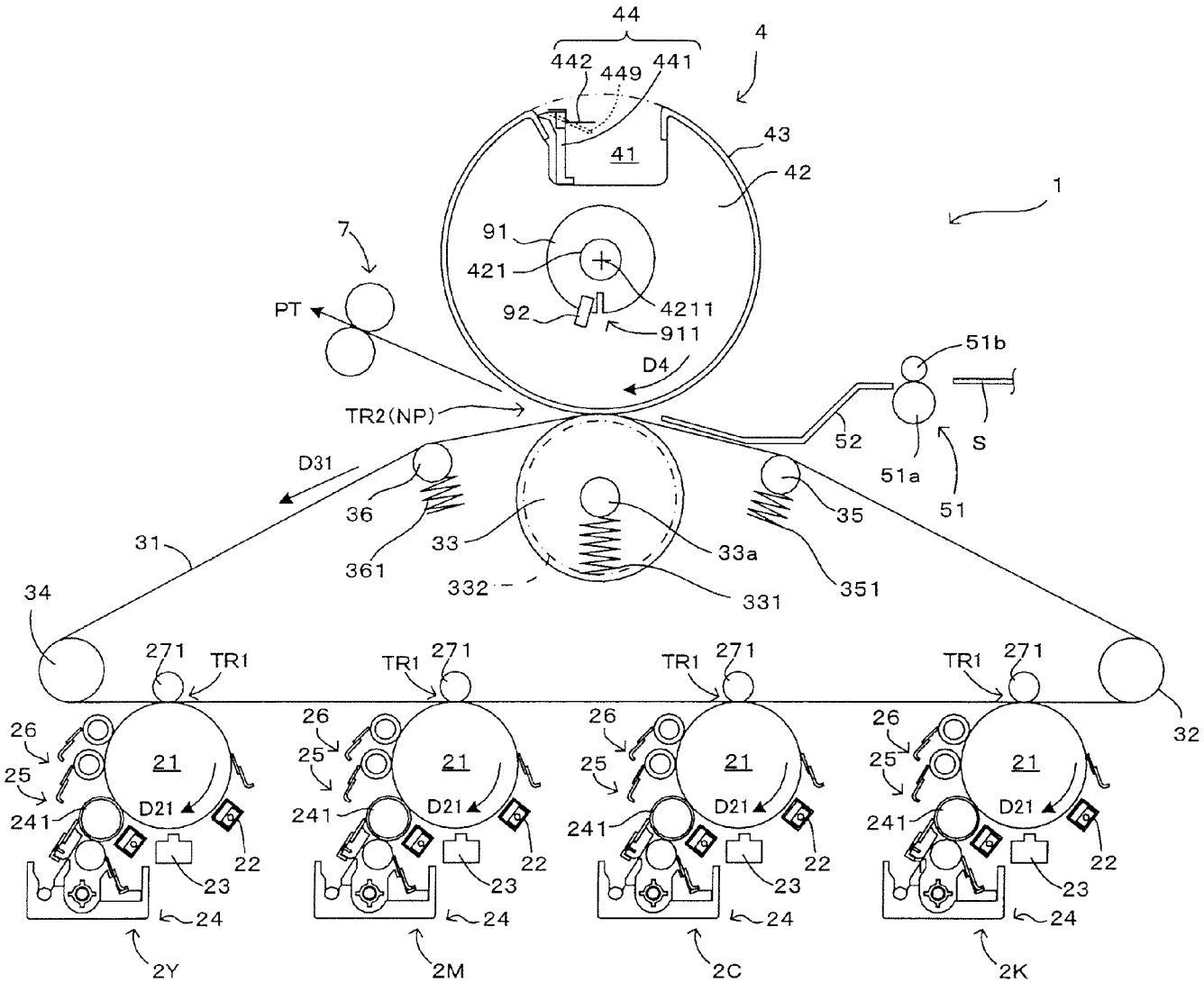
FIG. 7 is a view of the image-forming apparatus in a third embodiment of the invention.

FIG. 7 is a view of the image-forming apparatus in a third embodiment of the invention. The major points of difference with the first embodiment are that two tensioning rollers 35, 36 have been added, and biasing portions 351, 361 for supplying biasing force to the rollers 35, 36 have been added to the third embodiment. The rest of the configuration is substantially the same as in the first embodiment. Therefore, the following description centers on the points of difference.

In the third embodiment, the intermediate transfer belt 31 is wound around rollers 32, 33, 34, 35, 36. Among these, rollers 32 through 34 have the same function has the first embodiment. Rollers 35 and 36 are tensioning rollers. The roller 35 is a driven roller provided between the belt drive roller 32 and the secondary transfer backup roller 33. In other words, it is provided downstream from the wind-up position of the belt drive roller 32 and upstream from the wind-up position of the secondary transfer backup roller 33 in the belt traveling direction D31. Its rotation shaft is supported elastically by a biasing portion 351 such as a spring, and it adjusts the tension of the intermediate transfer belt 31. More specifically, the rotation shaft of the tensioning roller 35 is supported elastically by a biasing portion 351 which freely extends and retracts in a direction substantially perpendicular to a virtual plane connecting both the outer circumferential surface of the drive roller 32 and the outer circumferential surface of the secondary transfer backup roller 33. In this way, the tensioning roller 35 freely moves a predetermined amount in the same direction when the intermediate transfer belt 31 is wound around it. In a stationary state, the tensioning roller 35 is biased by the biasing portion 351 so that the intermediate transfer belt 31 wound around the belt drive roller 32 and the secondary transfer backup roller 33 under tension is pushed outward.

The other roller 36 is a driven roller provided between the secondary transfer backup roller 33 and the driven roller 34. In other words, it is provided downstream from the wind-up position of the secondary transfer backup roller 33 and upstream from the wind-up position of the driven roller 34 in the belt traveling direction D31. Its rotation shaft is elastically supported by a biasing portion 361 such as a spring, and it adjusts the tension of the intermediate transfer belt 31. Because its basic configuration is the same as tensioning roller 35, further explanation has been omitted.

The following operational effects are obtained since, in the third embodiment, a tensioning roller 35, 36 is provided both upstream and downstream from the secondary transfer backup roller 33 in the belt traveling direction D31. In the invention, when the secondary transfer roller 4 rotates around the rotation shaft 4211 at a predetermined position, and the recessed portion 41 opposes the secondary transfer backup roller 33, the secondary transfer backup roller 33 is displaced towards the rotation shaft 4211 of the secondary transfer roller 4. In other words, the interaxial distance between the rotation shaft 4211 and the rotation shaft of the backup roller 33 is constricted, and the intermediate transfer belt 31 wound around the backup roller 33 (i.e., the opposing portion 31*a*) enters into the recessed portion 41 from the virtual circumferential outer surface VS by distance H. When the recessed portion 41 is separated from the secondary transfer position TR2 and the transfer nip NP is formed, the backup roller 33 is returned. Thus, the way the intermediate transfer belt 31 travels changes depending on the displacement of the backup roller 33. Also, as in the second embodiment, when the backup roller 33 is displaced between the outer position and the inner position with respect to the virtual circumferential outer surface VS, the amount of displacement in the backup roller 33 increases, and the way the intermediate transfer belt 31 travels changes significantly. As a result, these cause speed fluctuations and vibrations in the intermediate transfer belt 31. In addition, the possibility of a temporary change in the tension of the belt 31 cannot be ruled out. Speed fluctuations and vibrations in the intermediate transfer belt 31 at the primary transfer position TR1 caused by a change in tension in the belt 31 disrupt the toner images being transferred at the image forming stations, and image quality deteriorates. For example, color discrepancies occur when the toner images of the various colors are superimposed at slightly different positions.

However, in the third embodiment, an action is performed wherein the rotation shafts of the two tensioning rollers 35, 36 are moved, and any tension fluctuation is thereby canceled out. Thus, speed fluctuations and vibrations of the intermediate transfer belt 31 at the secondary transfer position TR2 are prevented from reaching the primary transfer position TR1 corresponding to the various image forming stations 2Y, 2M, 2C, and 2K. Here, color discrepancies occur when the toner images of the various colors are superimposed at slightly different positions, but the third embodiment reliably prevents this effect on image formation.

Also, the tensioning rollers 35, 36 make contact with the intermediate transfer belt 31 on the inside of the intermediate transfer belt 31 (i.e., the reverse surface opposite the obverse surface of the intermediate transfer belt 31 which is the image carrying surface). The reasons are as follows. First, by making contact with the surface opposite the image carrying surface, the tensioning rollers 35, 36 can be reliably prevented from disrupting the toner image carried on the intermediate transfer belt 31, and from contaminating the intermediate transfer belt 31 with residual toner. Also, because the tension adjusting effect of the tensioning rollers is significant, the winding angle of the intermediate transfer belt 31 is effectively increased. If the tensioning rollers were to make contact with the image carrying surface and increase the winding angle, a large negative curvature would be required in the surface of the intermediate transfer belt 31. This would cause concerns regarding the effect on the toner image and would cause structural problems. For these reasons, the tensioning rollers 35, 36 make contact with the reverse surface of the intermediate transfer belt 31. In the third embodiment, two tensioning rollers 35, 36 are provided. However, there are no restrictions on the number and positioning of the tensioning rollers.

Figure 8A:
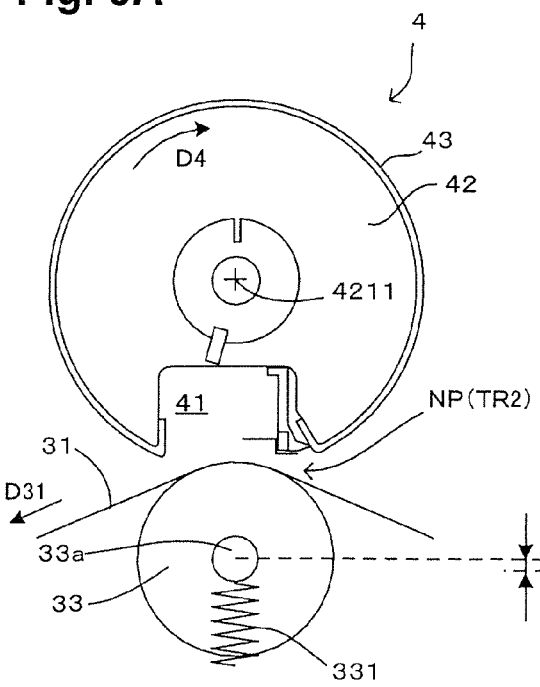
FIG. 8 is a view of the image-forming apparatus in a fourth embodiment of the invention.
Figure 8B:
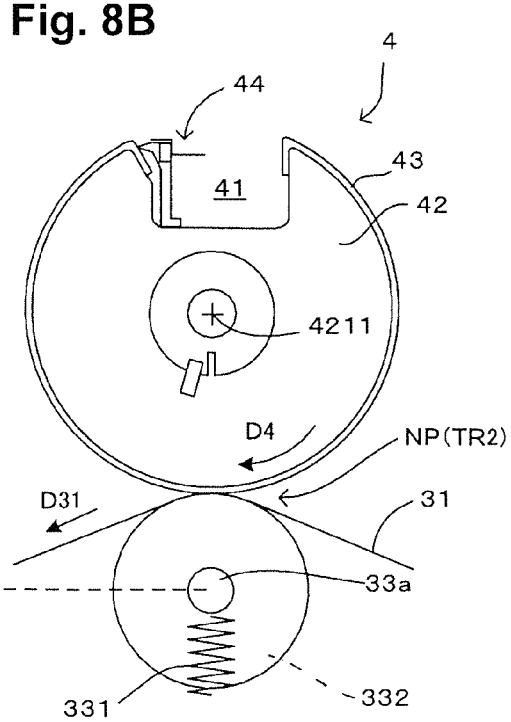
Figure 9A:
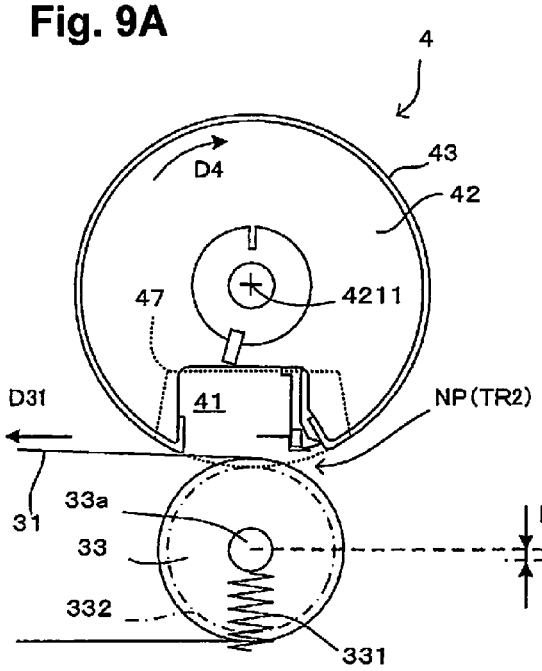
FIG. 9 is a view of the image-forming apparatus in a fifth embodiment of the invention.
Figure 9B:
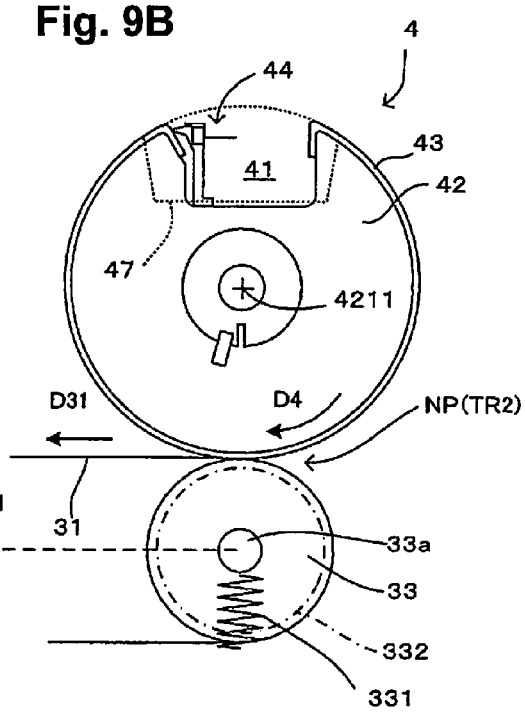
Figure 9C:
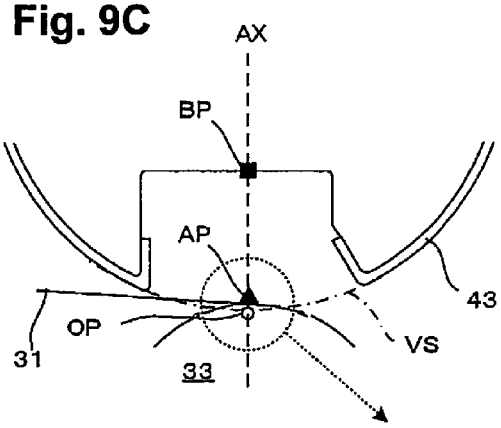
Figure 9D:
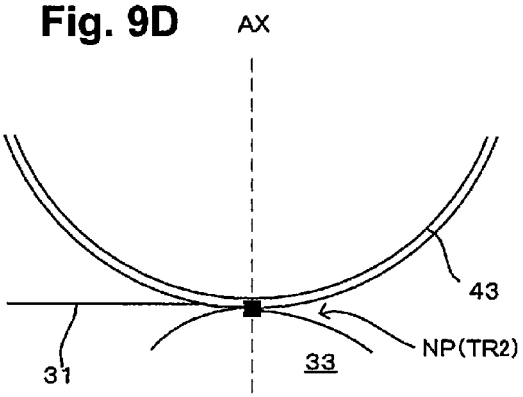
Figure 9E:
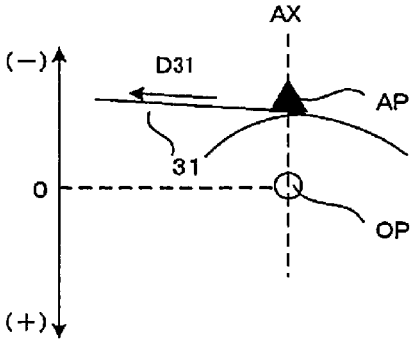

In the embodiments described above, the tension bearer 47 makes contact with the bearing 332 so that the opposing portion 31*a* of the intermediate transfer belt 31 is positioned to enter into the recessed portion 41 from the virtual circumferential outer surface VS before the secondary transfer roller 4 makes contact with the intermediate transfer belt 31 via the transfer medium S. In other words, the tension bearer 47 and the bearing 332 constitute the "position-regulating portion" of the invention. However, the position-regulating portion is not limited to this configuration. For example, the biasing force of the biasing portion 331 in the first embodiment can be adjusted so the biasing portion 331 can function as the "position-regulating portion" of the invention. More specifically, as shown in FIG. 8, when the tension bearer 47 and the bearing 332 are removed and the recessed portion 41 opposes the backup roller 33, the belt tension acting on the intermediate transfer belt 31 and the biasing force of the biasing portion 331 can be balanced so that the opposing portion 31*a* of the intermediate transfer belt 31 enters into the recessed portion 41 from the virtual circumferential outer surface VS. In this fourth embodiment, a tension bearer 47 and bearing 332 are not required, and the configuration of the apparatus is simplified. The biasing force of the biasing portions 311, 351, 361 in the second embodiment can also be adjusted to achieve a balanced state and eliminate the tension bearer 47 and the bearing 332 as in the fourth embodiment.

In addition, the invention can be applied, as shown in FIG. 9, to an image-forming apparatus in which the intermediate transfer belt 31 is wound around a backup roller 33 to form a transfer nip NP. In this apparatus, the positional relationships of points OP, AP and BP are shown in FIG. 9 (*c*) through (*e*). Therefore, as in the first embodiment, when the virtual circumferential outer surface VS which is an extension of the circumferential surface of the secondary transfer roller 4 intersects the intermediate transfer belt 31, the secondary transfer roller 4 makes contact with the intermediate transfer belt 31 via the transfer medium S. Afterwards, the image carried on the intermediate transfer belt 31 is transferred to a transfer medium S by the transfer nip NP formed by the circumferential surface of the secondary transfer roller 4 and the intermediate transfer belt 31. As a result, the operational effects obtained are similar to those of the embodiments described above.

What is claimed is:

1. An image-forming apparatus, comprising:

a transfer roller having a recessed portion in a circumferential surface;

a driving portion configured to rotatably drive the transfer roller;

an image carrier belt configured to carry an image;

a tension roller around which the image carrier belt is wound, the tension roller configured to make contact with the transfer roller interposed by the image carrier belt;

a biasing portion configured to bias the tension roller towards the transfer roller; and a position-regulating portion configured to, when the transfer roller rotates and the transfer roller and the image carrier belt make contact, cause a position to be maintained at which the image carrier belt wound around the tension roller intersects a virtual circumferential surface that is an extension of the circumferential surface of the transfer roller into the recessed portion, the position-regulating portion being configured to regulate an inter-axle distance between an axle of the transfer roller and an axle of the tension roller such that the inter-axle distance as the recessed portion formed in the circumferential surface of the transfer roller opposes the tension roller is smaller than the inter-axle distance as the tension roller makes contact with the transfer roller with the image carrier belt interposing between the tension roller and the transfer roller.

2. The image-forming apparatus according to claim 1, wherein the position-regulating portion has a rotating member rotating on the same rotation shaft as the rotation shaft of the transfer roller, and a supporting member configured to contact the rotating member and regulating the inter-axle distance when the transfer roller and the image carrier belt make contact.

3. The image-forming apparatus according to claim 2, wherein the supporting member is free-rotatably arranged to the tension roller with the an axis of the support member being the same as an axis of the tension roller, and an outside diameter of the supporting member is smaller than an outside diameter of the tension roller.

4. The image-forming apparatus according to claim 1, further comprising:

a tensioning roller configured to make contact with the image carrier belt and adjust a tension in the image carrier belt.

5. The image-forming apparatus according to claim 1, wherein the transfer roller has a gripping portion arranged in the recessed portion, the gripping portion adapted for gripping a transfer medium.

6. The image-forming apparatus according to claim 5, wherein the position-regulating portion causes a position to be maintained in which the gripping portion and the image carrier belt do not touch when the tension roller and the image carrier belt make contact.

7. The image-forming apparatus according to claim 1, wherein an outside diameter of the tension roller is smaller than an outside diameter of the transfer roller.

8. A method for forming an image, biasing a tension roller around which an image carrier belt is wound when a recessed portion formed in a circumferential surface of a transfer roller opposes the tension roller, and causing a virtual circumferential surface that is an extension of the circumferential surface of the transfer tension roller to intersect the image carrier belt;

causing the transfer roller and the image carrier belt to make contact via a transfer medium when the virtual circumferential surface intersects the image carrier belt, and once the transfer roller and the image carrier belt have made contact, transferring an image carried on the image carrier belt to the transfer medium in a transfer nip formed by the circumferential surface of the transfer roller and the image carrier belt regulating an inter-axle distance between an axle of the transfer roller and an axle of the tension roller such that the inter-axle distance as the recessed portion formed in the circumferential surface of the transfer roller opposes the tension roller is smaller than the inter-axle distance as the tension roller makes contact with the transfer roller with the image carrier belt interposing between the tension roller and the transfer roller.

* * * * *